US007159744B2

(12) United States Patent
Sterner et al.

(10) Patent No.: US 7,159,744 B2
(45) Date of Patent: Jan. 9, 2007

(54) FLOW PROMOTION DEVICE FOR BULK BAG DISCHARGER

(75) Inventors: Keith W. Sterner, Bethlehem, PA (US); David R. Gill, Stewartsville, NJ (US); John F. Simonof, Jr., Easton, PA (US)

(73) Assignee: Flexicon Corporation, Bethlehem, PA (US)

( * ) Notice: Subject to any disclaimer, the term of this patent is extended or adjusted under 35 U.S.C. 154(b) by 257 days.

(21) Appl. No.: 10/826,514

(22) Filed: Apr. 16, 2004

(65) Prior Publication Data

US 2004/0206780 A1 Oct. 21, 2004

Related U.S. Application Data

(60) Provisional application No. 60/463,931, filed on Apr. 18, 2003.

(51) Int. Cl.
*A45D 24/22* (2006.01)
*B65B 37/00* (2006.01)
*B65B 37/04* (2006.01)

(52) U.S. Cl. ..... 222/202; 222/196; 222/214; 414/415

(58) Field of Classification Search ..... 222/202, 222/105, 180, 181.1, 181.3, 182, 325, 408.5, 222/103, 196, 214, 203; 414/415, 403; 280/93.511, 280/124, 147, 155
See application file for complete search history.

(56) References Cited

U.S. PATENT DOCUMENTS 1,768,347 A * 6/1930 Trumble ..... 280/86.758
2,858,051 A * 10/1958 Cunningham ..... 222/103
3,037,787 A * 6/1962 Gottschald ..... 280/124.147
3,468,459 A * 9/1969 Bonneric ..... 222/196
4,810,156 A 3/1989 Pendleton et al.
4,966,311 A 10/1990 Taylor
5,141,135 A 8/1992 Volk, Jr.
5,271,439 A 12/1993 Alack
5,320,215 A * 6/1994 Brennan ..... 206/738
5,320,251 A * 6/1994 Ellis ..... 222/105
5,692,868 A * 12/1997 Riemersma ..... 414/403
5,699,730 A * 12/1997 Ogier et al. ..... 100/233
5,788,449 A 8/1998 Riemersma
5,947,333 A 9/1999 Hoffmann et al.
6,076,702 A 6/2000 Hoffmann et al.
6,186,360 B1 2/2001 Becker et al.
2001/0027822 A1* 10/2001 Bertolo ..... 141/66

FOREIGN PATENT DOCUMENTS

GB 2240965 * 8/1991 ..... 222/202

* cited by examiner

*Primary Examiner*—Kevin Shaver
*Assistant Examiner*—Stephanie E. Tyler
(74) *Attorney, Agent, or Firm*—Volpe and Koenig, P.C.

(57) ABSTRACT

A flow promotion device (FPD) for use in conjunction with a bulk bag discharger is provided. The FPD includes a center plate pivotably connected to the bulk bag discharger frame. Extension plates are pivotably attached to each end of the center plate. A connecting element is connected between a lever arm on each extension plate and the discharger frame, and an actuator is connected between the center plate and the frame. Upon activation of the actuator, the center plate is moved upwardly, and the extension plates are pivoted upwardly and inwardly by the connecting elements in order to press against the bag from three different directions using a single actuator. Two FPDs are preferably used on the bulk bag discharger.

10 Claims, 6 Drawing Sheets

FLOW PROMOTION DEVICE FOR BULK BAG DISCHARGER

CROSS-REFERENCE TO RELATED APPLICATIONS

This Application claims the benefit of U.S. Provisional Application No. 60/463,931, filed Apr. 18, 2003, which is incorporated by reference herein as if fully set forth.

BACKGROUND

The present invention relates to the unloading of bulk bags or flexible intermediate bulk containers (FIBCs) used as containers for powdered and particulate materials, and more particularly relates to the unloading of bulk bags fabricated from cloth like material, such as woven polyester material, which is usually sewn in a generally cubical or rectilinear configuration.

Bulk bags made of heavy cloth material have been known in the art for sometime. The bag typically has a central outlet spout at the bottom which is aligned with a discharge unit, for example a conveyer, hopper or the like, into which the material in the bag is intended to be discharged. To discharge material from the bag, the bag is hung in a support frame and the spout is engaged with a discharge unit. The spout is opened and the particulate material flows via gravity through the spout.

It is a characteristic of some particulate materials contained in bulk bags to resist or stop flowing out of the spout when the material remaining in the bag reaches the material's angle of repose or bridges over the spout. Since the bottom of the bag, extending from the spout to the walls, is typically not at angle greater than the material's angle of repose, not all of the material will be discharged through the spout by gravity. The material remaining in the bag after the discharge by gravity often forms a cone shape inside the container. The inner face of this cone shape, formed by the material, extends from the spout in the bottom of the bag upward at an angle to the walls and corners of the bag. The angle of repose at which this cone shape occurs and discharge by gravity ends depends on the physical characteristics of the bulk material involved.

To promote flow and reduce the likelihood of stacking of material along the walls, it is known in the art to use rotatable plate assemblies adjacent the bottom of the bag. The rotatable plates rotate from a substantially horizontal position to an inclined position to push the bottom corners of the bag inward to promote flow towards the central spout. While the rotatable plate assemblies have proven successful in helping promote flow, some materials having a high angle of repose and resistance to flowing freely still tend to stack along the walls and the corners of the bag.

An additional solution, which was developed by the assignee of the present application and is disclosed in U.S. Pat. No. 6,290,098, which is incorporated herein by reference as if fully set forth, provides a flow promotion apparatus for use in conjunction with a bulk bag discharger having a pair of spaced apart mounting brackets, an actuator, a connecting rod and a push bar. The actuator is pivotably connected at one end to one of the mounting brackets. The connecting rod is pivotably connected at one end to the other mounting bracket and pivotably connected at its other end to the piston. The push bar is pivotably coupled at the junction between the actuator and connecting rod, and actuation of the actuator extends the push bar to agitate material along the side walls of the bag.

However, for some materials it is still necessary to provide a better way to promote flow from the bulk bag, especially from the corners.

SUMMARY

The present invention provides a flow promotion device (FPD) for use in conjunction with a bulk bag discharger. The FPD includes a center plate pivotably connected to the bulk bag discharger frame. Extension plates are pivotably attached to each end of the center plate. A connecting element is connected between a lever arm on each extension plate and the discharger frame, and an actuator is connected between the center plate and the frame. Upon activation of the actuator, the center plate is moved upwardly, and the extension plates are pivoted upwardly and inwardly by the connecting elements in order to press against the bag from three different directions using a single actuator.

In one preferred embodiment, FPDs are located on opposing sides of the frame, such that upon actuation of the actuators, the bag is pressed on from six directions to promote flow.

BRIEF DESCRIPTION OF THE DRAWING(S)

DETAILED DESCRIPTION OF THE PREFERRED EMBODIMENTS

Figure 1:
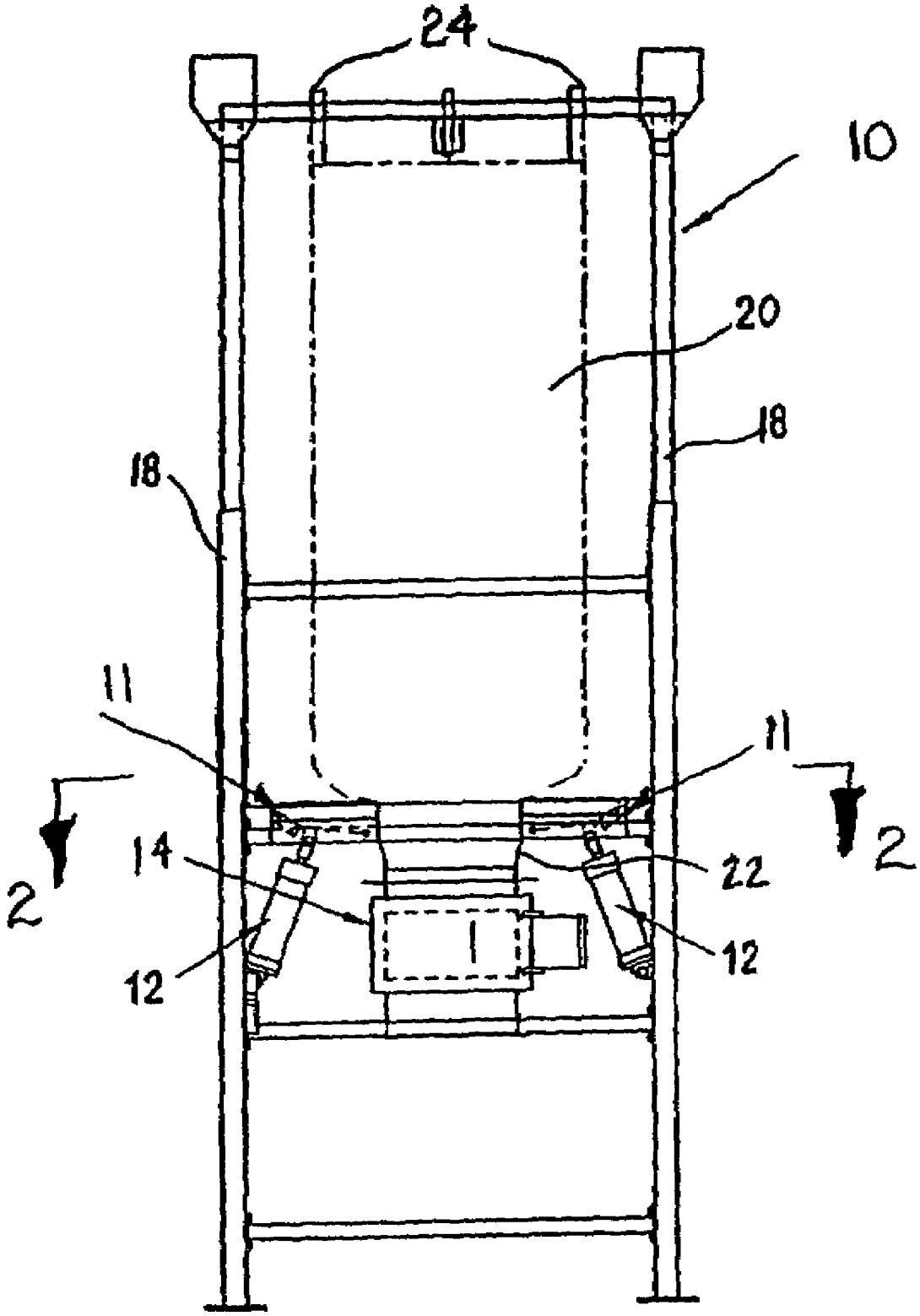
FIG. 1 is an elevational view of a bulk bag discharger in accordance with the present invention.

Certain terminology is used in the following detailed description for convenience only and is not considered limiting. The words "upper" and "lower" designate directions in the drawings to which reference is made. Additionally, the words "left" and "right" are similarly used to designate directions in the drawings. The terms "a" and "one" are defined as including one or more of the referenced item unless specifically noted.

Referring now to FIG. 1, a bulk bag discharger 10 having a flow promotion device 11 in accordance with the present invention is shown. The discharger 10 includes a frame 18 for suspending a bulk bag 20 via straps 24 on the bag 20. The bag 20 includes a spout 22 that is engaged with a discharge unit 14 on the frame 18. The discharge unit 14 can be of any configuration, such as an enclosed dust proof box surrounding an inflatable seal or other connector, or a clamp ring arrangement that clamps the bag spout to a discharge tube, or any other suitable connection. Actuators 12 are connected between the frame 18 and the flow promotion devices (FPDs) 11 in accordance with the invention.

Figure 2:
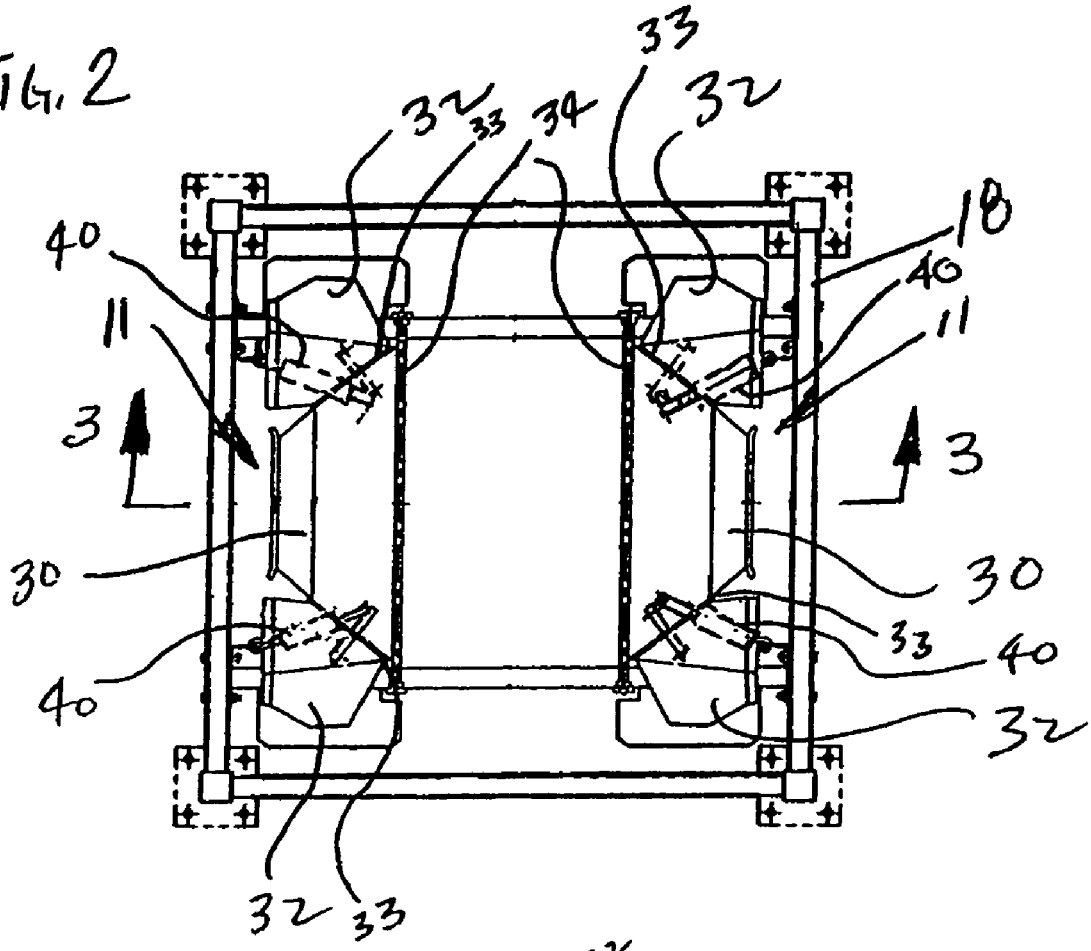
FIG. 2 is a plan view of the flow promotion devices (FPDs) in the installed position taken along line 2—2 in FIG. 1.
Figure 3:
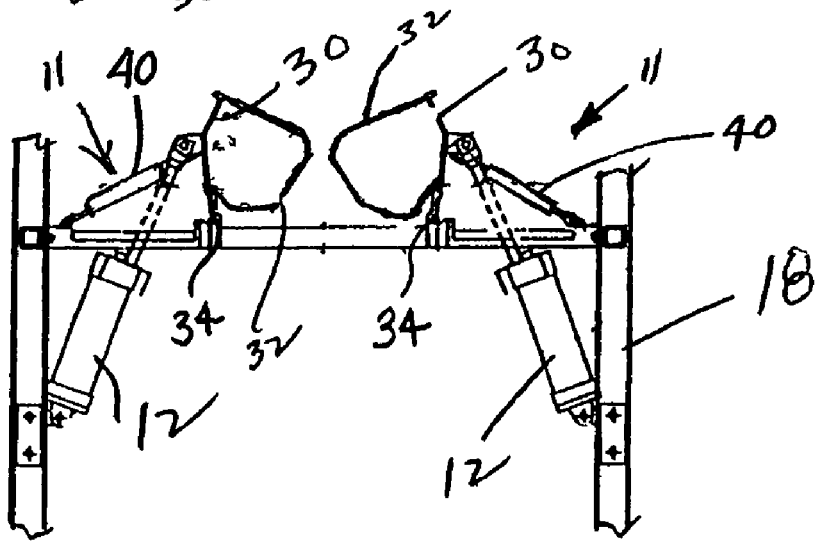
FIG. 3 is a side view taken along line 3—3 in FIG. 2, with the FPDs shown in the actuated position.
Figure 4:
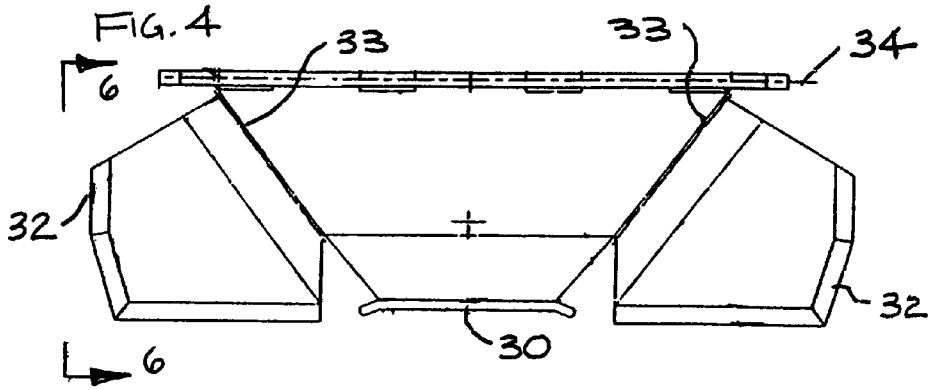
FIG. 4 is a plan view of a FPD in accordance with the invention.
Figure 5:
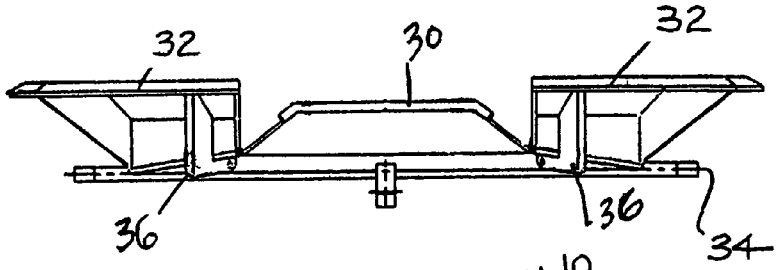
FIG. 5 is a side view of the FPD of FIG. 4.
Figure 6:
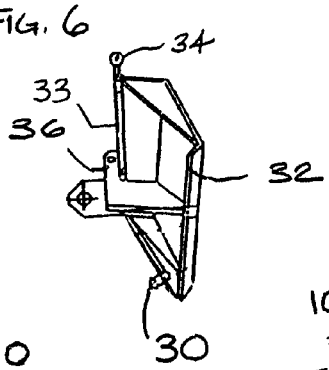
FIG. 6 is an end view of the FPD shown in FIG. 5, taken along line 6—6 in FIG. 4.

The FPDs 11 are shown in more detail in FIGS. 2 and 3. As shown in FIG. 2, a FPD 11 is installed on each side of the frame 18. Each FPD 11 includes a central plate 30 to which each actuator 12 is pivotably connected. As the actuators 12 are activated, the central plates 30 rotate upwardly to engage the sides and horizontal corners of the bag 20 form opposing sides to promote flow. Extension plates 32 are pivotably attached to the ends of each of the central plates 30, preferably with a hinge 33. The hinge lines of the extension plates 32 are preferably set at an angle to the pivot axis 34 of the central plates 30. In the preferred embodiment, the angle is generally between about 30° and about 90°. Preferably, the angle is approximately 45°.

Figure 7:
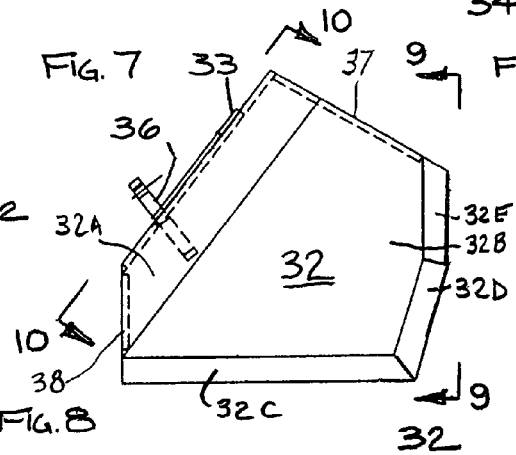
FIG. 7 is a top view of a extension plate used in the FPD of FIG. 4.
Figure 9:
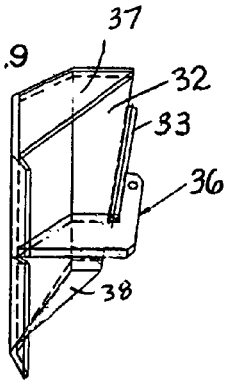
FIG. 9 is a right side view of the extension plate of FIG. 7.
Figure 10:
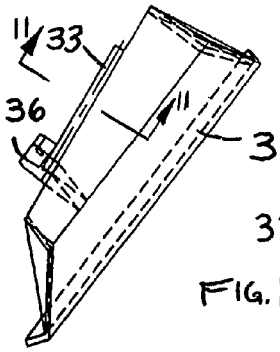
FIG. 10 is a left-rear view of the extension plate of FIG. 7 taken along line 10—10 in FIG. 7.
Figure 8:
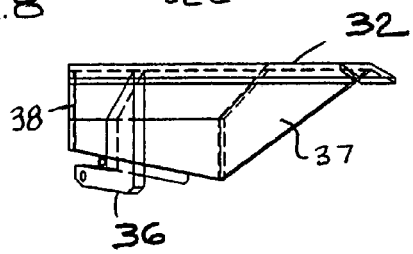
FIG. 8 is a front side view of the extension plate shown in FIG. 7.
Figure 11:
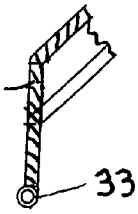
FIG. 11 is a partial section view taken along line 11—11 in FIG. 10.
Figure 18:
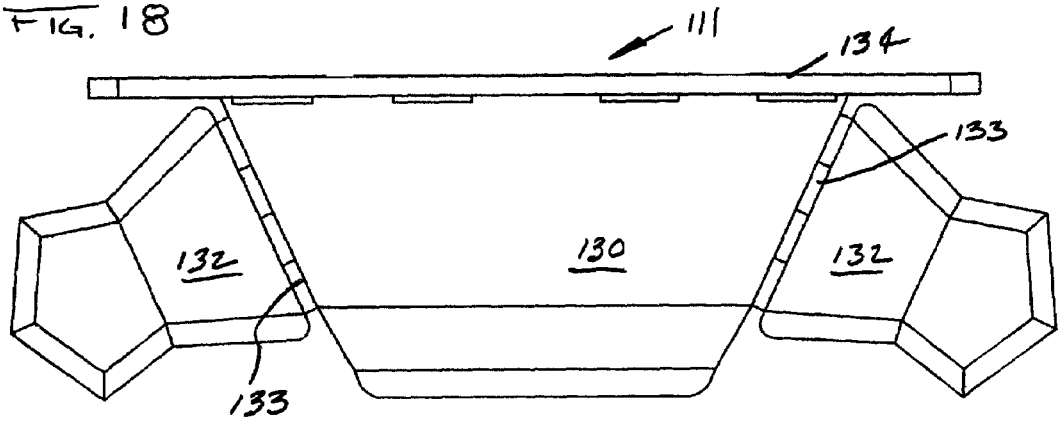
FIG. 18 is a view similar to FIG. 4 of a second embodiment of the FPD in accordance with the present invention.
Figure 19:
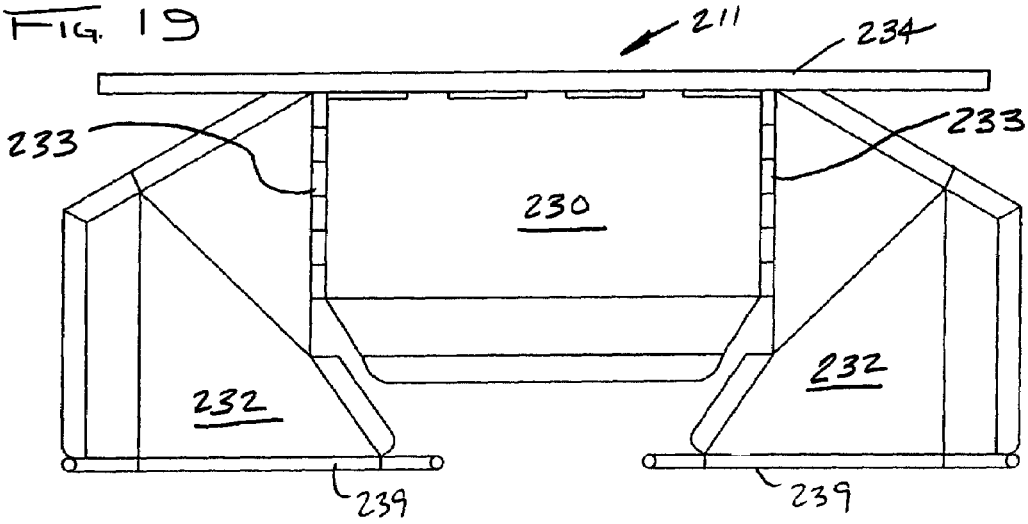
FIG. 19 is a view similar to FIG. 4 of a third embodiment of an FPD in accordance with the present invention.
Figure 20:
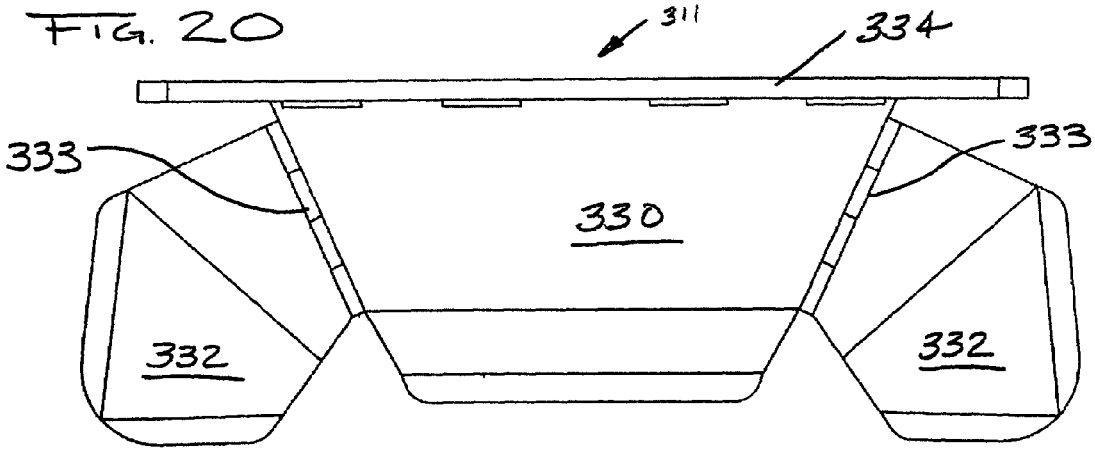
FIG. 20 is a view similar to FIG. 4 of a fourth embodiment of an FPD in accordance with the present invention.

The extension plates 32 can be flat plates; however, in order to increase the flow promoting effect, they are preferably bent or shaped to protrude upwardly from the plane of a major surface of the central plate 30 when in a generally open position. A preferred shape is shown in FIGS. 4–11. In this embodiment, the extension plate 32 has two major surfaces 32A, 32B, as noted in FIG. 7, that contact the bag as the extension plates 32 move in. The edges 32C, 32D, 32E, also indicated in FIG. 7, are bent back to provide a smooth edge that will not rip or tear the bag. Gussets 37 and 38 are provided on the ends. However, other inwardly bent or curved shapes that protrude upwardly and inwardly that do not have sharp edges or corners that will contact the bag 20 can be used. For example, alternate embodiments of FBDs 111, 211 and 311 are shown in FIGS. 18–20, respectively.

Figure 16:
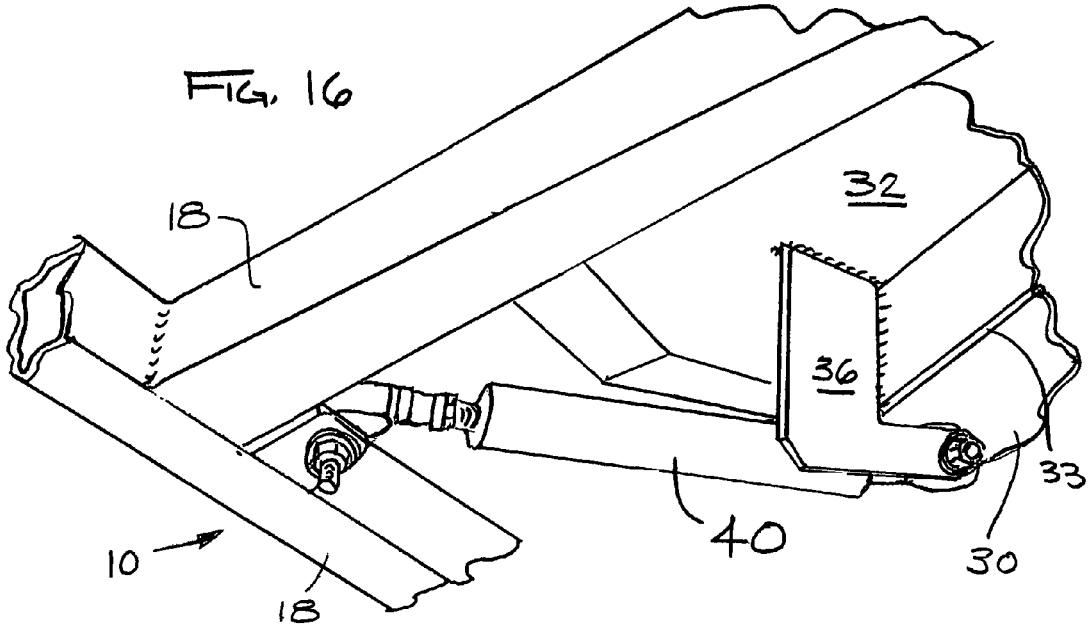
FIG. 16 is an isometric view of a sliding link installed between a extension plate of the FPD and the frame of the bulk bag discharger.

A lever arm 36 is located on the bottom of each extension plate 32, and is preferably welded in place. The lever arm 36 is preferably L-shaped and oriented generally normal to the hinge 33. As shown in FIG. 7, the lever arm 36 extends past the hinge 33, and in the preferred embodiment is set at 75°. As shown in FIGS. 2, 3 and 16, sliding links 40 are connected between the frame 18 and each of the lever arms 36 on the extension plates 32. Preferably, the extension plates 32 and plate 30 are formed of bent-up and welded metal. However, other suitable materials could be utilized.

Figure 12:
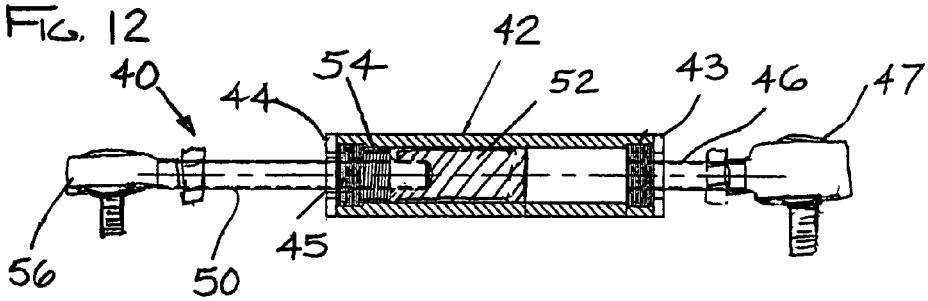
FIG. 12 is a side view, partially in section, of the sliding link for the FPD of FIG. 2.
Figure 14:
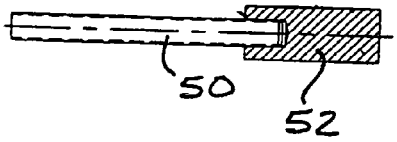
FIG. 14 is a side view, partially in cross-section of the second end of the link.
Figure 13:
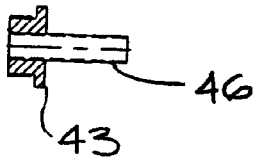
FIG. 13 is a side view, partially in cross-section of a first end of the link of FIG. 12.

The links 40 preferably have a ball joint on each end to allow pivoting movement in any direction. A detail of the link 40 is shown in FIG. 12. Each link 40 includes a hollow body 42, with end caps 43, 44. A threaded rod 46 is connected directly to the first end cap 43, as shown in FIG. 13, and a ball joint 47 is connected to the free end. The second end cap 44 has an opening 45 through which a threaded rod 50 of a slider 52 extends. A preferred slider 52/rod 50 assembly is shown in FIG. 14. A compression spring 54 is located inside the body 42 (shown compressed in FIG. 12) and acts against the slider 52 and the second end cap 44. A second ball joint 56 is connected to the rod end 50.

In use, as the main actuators 12 are activated to move the central plate 30 upwardly to promote flow of material in the bag 20 out through the spout 22, the extension plates 32 are also moved upwardly. The sliding links 40, connected between the lever arm 36 on each extension plate 32 of the FPDs 11 and the frame 18, cause the extension plates 32 to pivot upwardly/inwardly about the hinges 33 to press in on the four vertical corners of the bag 20, creating better flow of material from in the bag 20 and allowing material to discharge more easily. In addition to the action of the central plates 30, this provides agitation and flow promoting forces from four additional directions when two of the FPDs 11 are mounted to the bulk bag discharger 10.

The sliding links 40 can expand and/or contract within a defined range to prevent overstressing. Additionally, when the actuators 12 are lowered, the links 40 prevent free falling or uncontrolled movement of the extension plates as they return to the original position.

It is also possible to utilize slotted connections at one or both ends of the sliding links 40, depending on the particular configuration of the extension plates 32 and the angle of the hinge 33.

Figure 15:
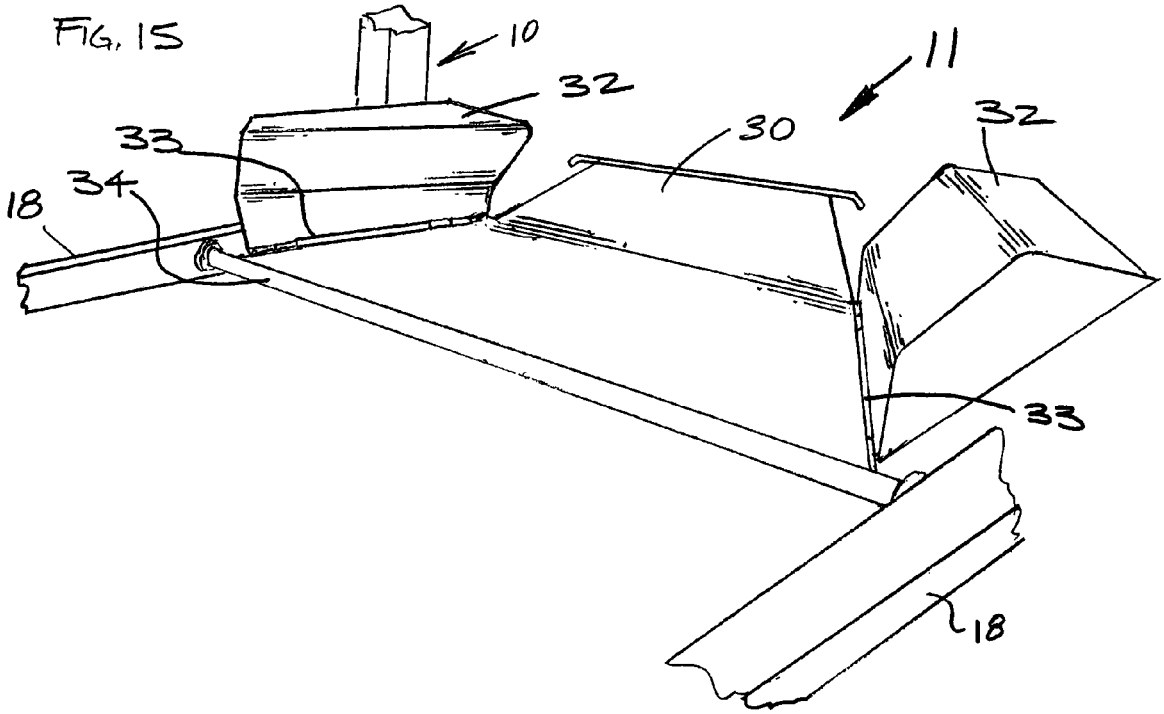
FIG. 15 is an isometric view showing one FPD installed on the bulk bag discharger, adjacent to the opening in the frame for the bulk bag discharge spout.

FIG. 15 shows the FPD 11 installed on one side of a bulk bag discharger 10, with the FPD 11 shown in the down position. In use, the bag spout 22 extends down through the frame opening, partially shown, to the discharge unit.

FIG. 16 shows the sliding link 40 in the installed position between the lever arm 36 and the frame 18. One link 40 is required for each extension plate 32 of the FPD 11. It would also be possible to utilize a flexible cable, chain or other suitable connecting element in place of the links 40

Figure 17:
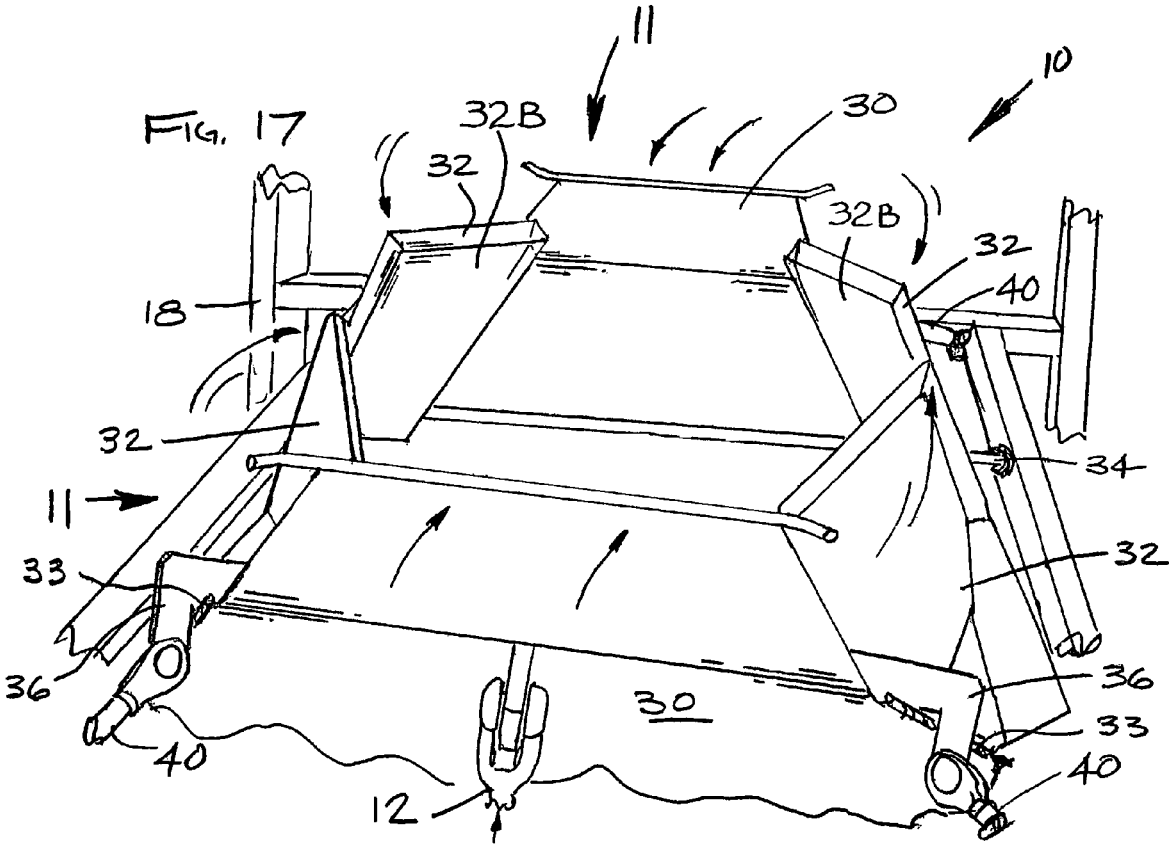
FIG. 17 is an isometric view showing two FPDs in accordance with the invention in the activated position in which the central plate and the two extension plates of each FPD are in the extended position to apply force on a bulk bag from six directions to dislodge powdered or particulate material from the corners and sides of a bulk bag as it is being emptied.

FIG. 17 shows the FPDs 11 in the up/in flow promotion position in which the bag would be pressed inwardly from six directions, as indicated by the arrows which show the upward and inward pivoting movement, utilizing only the two actuators 12. The ends of the links 40 are also visible at the back side of the nearer FPD 11. The major surface 32B of each extension plate 32 is nearly vertical in the full up position, and preferably extends past vertical, to provide better flow promotion. This nearly forms a closed six-sided box to positively push all four vertical corners and the sides of the bag toward the center.

FIG. 18 shows a second embodiment of a FPD 111, which is similar to the FPD 11. It includes a central plate 130, and two extension plates 132, each having two major surfaces, and edges that are angled back from the major surfaces to avoid damage to the bag during use. The hinges 133 are at about 60° from the main hinge axis 134.

FIG. 19 shows a third embodiment of a FPD 211, which is similar to the FPD 11. It includes a central plate 230, and two extension plates 232, each having three major surfaces, and edges that are angled back from the major surfaces to avoid damage to the bag during use. The hinges 233 are at about 90° from the main hinge axis 234. Additionally, round bars 239 are located at the ends of the extension plates 232 opposite from the hinges 233 in order to assist in flow promotion by pushing in the bag corners.

FIG. 20 shows a fourth embodiment of a FPD 311, which is similar to the FPD 11. It includes a central plate 330, and two extension plates 332, each having two major surfaces and outer edges that are angled back from the major surfaces to avoid damage to the bag during use. The hinges 333 are at about 60° from the main hinge axis 334.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A bulk bag discharger having at least one flow promotion device (FPD), comprising:

a center plate pivotably connected to a frame of the bulk bag discharger;

extension plates pivotably attached to each end of the center plate, each extension plate including a lever arm;

a connecting element connected between the lever arm on each of the extension plates and the frame; and an actuator connected between the center plate and the frame, whereby upon activation of the actuator, the center plate is moved upwardly, and the extension plates are pivoted upwardly and inwardly by the connecting elements in order to press against the bag from at least three different directions.

2. The bulk bag discharger of claim 1, further comprising a second FPD located on an opposing side of the frame from the FPD, such that upon actuation of the actuators, the bag is pressed on from six directions to promote flow.

3. The bulk bag discharger of claim 1, wherein the connecting element is a link that includes first and second ends that can be extended apart from one another against a resilient biasing force.

4. The bulk bag discharger of claim 3, wherein a first end of the link is connected to a hollow link body, and a second end of the link comprises a slider that is moveable within the body and a rod end that is connected to the slider and extends out of the hollow link body.

5. The bulk bag discharger of claim 4, wherein a first ball joint is connected to the first end and a second ball joint is connected to the rod end at the second end of the link.

6. The bulk bag discharger of claim 1, wherein each extension plate includes two major surfaces for contacting the bag.

7. The bulk bag discharger of claim 6, wherein the major surfaces are set at an angle relative to one another to form a protruding area that is directed toward a bulk bag receiving space of the bulk bag discharger.

8. The bulk bag discharger of claim 1, wherein the center plate is connected to the frame along a pivot axis, and the extension plates are pivotably connected to the center plate by hinges that are set at an angle of about 30° to about 90° to the pivot axis.

9. A method of promoting flow of particulate or powdered material from a bulk bag as the bulk bag is discharged, comprising:

providing a flow promotion device (FPD) having a center plate pivotably connected to a frame of the bulk bag discharger, extension plates pivotably attached to each end of the center plate, each extension plate including a lever arm, and a connecting element connected between the lever arm on each of the extension plates and the frame;

activating an actuator located between the center plate and the frame; and pressing inwardly on sides and corners of the bulk bag from at least three different directions at approximately the same time with the FPD utilizing the center plate and the extension plates in order to promote the flow of the material from the bulk bag.

10. The method of claim 9, further comprising:

providing a second FPD on an opposite side of the frame from the first FPD;

activating the actuator of the second FPD at the same time as the actuator of the first FPD; and pressing inwardly on the sides and corners of the bulk bag from at least three additional different directions with the second FPD so that the bag is pressed against from at least six different directions at approximately the same time to promote the flow of material from the bulk bag.

* * * * *